United States Patent [19]

Townsend

[11] Patent Number: 4,872,676

[45] Date of Patent: Oct. 10, 1989

[54] ENERGY ABSORBING BALL

[76] Inventor: Charles P. Townsend, Claire Road, Kirby Cross, Frinton on Sea, Essex C013 0LX, United Kingdom

[21] Appl. No.: 171,845

[22] Filed: Mar. 22, 1988

[51] Int. Cl.[4] ..... A63B 39/00; A63B 37/08

[52] U.S. Cl. ..... 273/58 H; 273/58 F

[58] Field of Search ..... 273/58 F, 128 A, 56, 273/57, 58 B, 58 BA, 58 R, 58 H

[56] References Cited

U.S. PATENT DOCUMENTS 3,734,498 5/1973 Seiersen ..... 273/58 F 4,448,418 5/1984 McNeill ..... 273/58 F

*Primary Examiner*—George J. Marlo

*Attorney, Agent, or Firm*—Laubscher, Presta & Laubscher

[57] ABSTRACT

An energy absorbing ball comprising a resilient structural outer casing and an energy absorbent core, characterized in that the core is formed of a non-resilient deformable material adapted on rolling to move relative to the casing. The core may comprise, in part, a low viscosity liquid and a surface active agent. The inner surface of the casing is smooth and the deformable material consists by volume of from 40–70% of the core volume, thereby to provide an average deviation on striking of less than 0.21 meters per meter run.

4 Claims, 1 Drawing Sheet

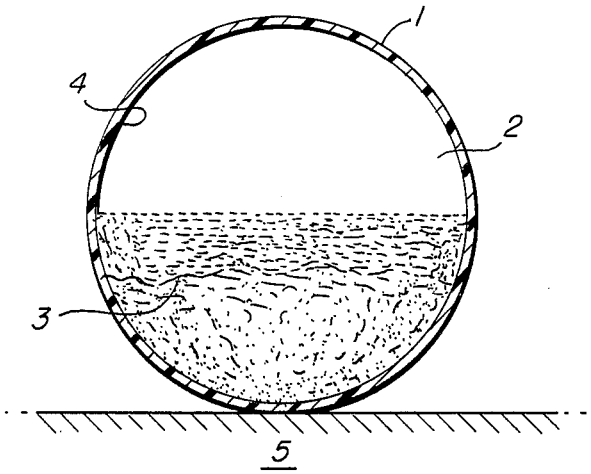
1
2
3
4
5

ENERGY ABSORBING BALL

BACKGROUND OF THE INVENTION

The present invention relates to an energy absorbing ball in general, and in the particular to an energy absorbing croquet ball primarily for indoor use.

Many outdoor games, particularly croquet, golf and bowls, rely at least in part on contact between a mown grass surface and the exterior of the ball to slow the ball during its course across an even sward. The translation of such games into buildings renders necessary the adoption of "grass substitute" carpets so that the same balls can be utilized, since in the absence of such surfaces, and where the game is played for example on a hard level surface, the balls tend to move so fast that the game becomes substantially unplayable. However, the necessary carpets are comparatively expensive and can only be afforded rarely. For this reason games such as croquet, for example, which is a minority interest, is in practice not translatable into such venues as halls.

SUMMARY OF THE INVENTION

The present invention seeks to deal with this problem by providing an energy absorbing ball which, although preferably weighing substantially the same as a normal ball, rolls to a halt in a much shorter distance.

Balls with energy absorbing cores are, of course, known. For example golf balls often include a resilient inner core which assists in prolonging the flight of a golf ball in response to the application of a certain force. Cores of the present invention have precisely the opposite effect in that they are non-resilient and hence deform in an energy absorbative way.

According to the present invention, therefore, there is provided a ball comprising a resilient structural outer casing and an energy absorbant core, characterized in that the core is formed of a non-resilient deformable material adapted on rolling to move relative to the casing.

Suitable non-resilient deformable materials are any particulate solid, particularly in the form of spheres or a viscous liquid. A suitable particulate material may be, for example, sand, salt granules, glass beads or roller bearings.

For the best results the core materials may consist of from 25–85% by volume of the interior of the core, preferably from 40–70%, most preferably form 60–70%, and at best from 65–68% by volume thereof.

Balls in accordance with the present invention, when hit with a croquet mallet, roll far less for a given stroke than an equivalent ball of the same weight.

A further problem with balls of this type is deviation. With many materials which give satisfactory performance in reducing the rolling distance for a given stroke, it is a problem that the materials tend to affect the ball in an unpredictable way.

To alleviate this problem the balls of the invention may have inserted thereinto a predetermined weight of a low viscosity liquid such as water. It has been found that although this slightly reduces the energy absorbant effect of the material, it does markedly reduce deviation.

Deviation is even more beneficially affected if the low viscosity liquid includes a very small proportion of a surface active agent such as TEPOL ®.

For the purposes of this application, a "surface active agent" is defined as a substance capable of reducing surface tension at a liquid/solid interface.

BRIEF DESCRIPTION OF THE DRAWING

The drawing is an elevational view in section of an energy absorbing ball constructed in accordance with the principles of the present invention.

DESCRIPTION OF THE PREFERRED EMBODIMENT

The invention will now be described, by way of illustration only, with reference to the accompanying drawing which shows in vertical transverse section a croquet ball in accordance with the present invention. The croquet ball comprises a resilient structural outer casing formed of polyurethane with an external source formed to the pattern common to all croquet balls. The resilient structural outer casing (1) is formed with a smooth internal surface (4) which defines a core volume (2). The core volume (2) is provided over 40–70% of its volume with core materials (3) which may comprise glass beads, water, or other low viscosity liquid, and a surface active agent such as Tepol.

The ball, as shown, rolls on a surface (5) without deformation due to its own weight; the strength of the outer casing being sufficient to withstand slight deformation on contact with the croquet mallet. The balls in accordance with the present invention, and as just described, show low deviation on being struck by a standard mallet of given force, and travel much less far than an equivalent "hard" croquet ball.

The outer casing of the croquet ball formed of polyurethane is formed in the usual way with a knurled outer surface and a smooth inner surface. An aperture is pierced therethrough at an appropriate point.

The so formed outer casing is then allowed to set and become fully hardened. The inner core is then filled with glass beads sold under the mark BALLERTINI ®, of a generally spherical configuration and having a size between 0.8 and 1.2 mm. Salt granules having a particle size of 0.8 and 2 mm or, in some circumstances, sand having particle sizes of 0.25 mm can also be used. In the present instance the glass beads are added until the weight of the whole ball is 453 gms (16 ozs.). This is the standard weight of croquet balls. The percentage by volume of the ball filled will not be entirely constant but will be between 60 and 70% by volume (254 gms by weight). Obviously the particle sizes of the glass beads can be selected so as to achieve the right packing density. A plug is then formed in the aperture to permanently retain the glass beads in the core. It is found that the application of a mallet stroke to a croquet ball so formed results in the ball stopping on a hard even surface.

The same conditions applied to a standard ball would result in the ball going very much farther, for example about 4 times farther, or more usually hitting an interior wall.

The effects of adding to a standard 198 gm shell of a croquet ball given amounts of glass beads are given below in Table I.

In these experiments the ball containing varying given amounts of beads is hit with a standard force and the rolling distance and deviations from a straight line are recorded.

Deviation per unit of rolling length is then calculated for the purposes of accurate comparison.

TABLE 1

PERFORMANCE OF CROQUET BALL (198 gm shell) AT STANDARD STRIKING VELOCITY

| Run | Wt. of beads gms. | Rolling distance meters | Average Deviation in meters | Deviation per unit rolling length |
|---|---|---|---|---|
| 1 | 85 | 1.2 | 0.15 | 0.12 |
| 2 | 99 | 1.1 | 0.19 | 0.17 |
| 3 | 113 | 0.86 | 0.06 | 0.07 |
| 4 | 127 | 0.82 | 0.10 | 0.12 |
| 5 | 141 | 0.77 | 0.10 | 0.13 |
| 6 | 155 | 0.71 | 0.07 | 0.10 |
| 7 | 170 | 0.65 | 0.12 | 0.18 |
| 8 | 184 | 0.66 | 0.10 | 0.15 |
| 9 | 198 | 0.62 | 0.10 | 0.16 |
| 10 | 212 | 0.69 | 0.04 | 0.06 |
| 11 | 226 | 0.65 | 0 09 | 0.14 |
| 12 | 240 | 0.62 | 0.11 | 0.18 |
| 13 | 254 | 0.73 | 0.07 | .095 |
| 14 | 269 | 0.76 | 0.23 | 0.30 |
| 15 | 283 | 0.78 | 0.19 | 0.24 |
| 16 | 297 | 0.93 | 0.20 | 0.21 |
| | | | Unit Av. Dev. 0.15 | |

All figures average of three readings.

From the above it will be seen that the rolling distance per stroke is high where the weight of beads is either very low or very high, but is much the same in mid range.

However, surprisingly deviation only increases where large amounts of beads are used.

The average deviation per unit rolling length is 0.15 metres for balls with only dry beads therein.

In Table 2 we show the effects of adding 100 gms of water to run 6 of Table 1: (155 gms glass beads in a shell of 198 gms).

TABLE 2

ADDITION OF WATER (and TEPOL) TO A CROQUET BALL SHELL

SHELL 198 gms
GLASS BEADS 155 gms
WATER 100 gms (TOTAL 453 gms)

| Rolling Distance Average 10 runs | Average Deviation Average 10 runs | Average Deviation per unit rolling length |
|---|---|---|
| 1.24 m | 0.26 m | 0.21 m |
| with 1 drop Tepol per 100 gms water | | |
| 1.26 m | 0.12 m | 0.09 |
| with 2 drops Tepol per 100 gms water | | |
| 1.26 m | 0.21 m | 0.16 m |

It will be seen that although the average rolling distance increases a little, the average deviation, particularly with one drop of Tepol, is reduced from 0.15 to 0.09 metres. Further whereas with a "dry" ball occasionally very wide deviations occur, these are not recorded where a "wet" ball was used.

By use of the balls in accordance with the present invention it is possible to play indoor croquet in a room of normal size. Accordingly, the game may be played in small community halls or large living room without damage to the walls.

Similar considerations apply to golf balls and bowls' woods which can be similarly manufactured.

It is believed that the energy absorbing cores in accordance with the present invention are a function of the following: friction between the particles forming the core and the interior of the casing, the lifting effect on the core material when the ball rolls, and the reaction to impact allowed for by a deformable core surrounded by a resilient casing.

It will also be appreciated that where a core of fine particles size such as sand is utilized, it is possible to "hand" the ball by tapping the contents of the core to one side before imparting rolling motion to it. Where such effects are not required, the addition of a low viscosity liquid with a surface active agent alleviates the effects.

The invention relates therefore to an energy absorbant ball, particularly a croquet ball, as hereinbefore set forth; and to an indoor game of croquet played with a ball in accordance with the present invention.

I claim:

1. A low-deviation croquet ball comprising a resilient structural outer casing and an energy absorbent core, said core being formed of a non-resilient deformable material adapted on rolling to move relative to the casing, said deformable material consisting by volume of from 40–70% of the core volume, characterized in that the inner face of the outer casing is smooth and in that the deformable material includes a low viscosity liquid and a small amount of surface active agent, thereby to provide an average deviation on striking of less than 0.21 meters per meter run.

2. A ball according to claim 1 having a total weight of approximately 453 gms.

3. A ball according to claim 2 wherein the material comprises 155 gms glass beads, 100 gms water, and 1 drop of surface active agent.

4. A ball according to claim 1 characterized in that the low viscosity liquid is water and includes no more than two drops of surface active agent per 100 grams of water.

* * * * *